US006938630B2

(12) United States Patent
Perner

(10) Patent No.: US 6,938,630 B2
(45) Date of Patent: Sep. 6, 2005

(54) DEVICE FOR ENABLING PERSONS WITH PARESIS OF LOWER LIMPS TO WALK

(75) Inventor: Barbara Perner, Warsaw (PL)

(73) Assignee: Firma Ortopedyczna "Medort" S.A. (PL)

( * ) Notice: Subject to any disclaimer, the term of this patent is extended or adjusted under 35 U.S.C. 154(b) by 260 days.

(21) Appl. No.: 10/182,267

(22) PCT Filed: Jan. 29, 2001

(86) PCT No.: PCT/PL01/00008

§ 371 (c)(1),
(2), (4) Date: Jul. 25, 2002

(87) PCT Pub. No.: WO01/66059

PCT Pub. Date: Sep. 13, 2001

(65) Prior Publication Data

US 2003/0000561 A1 Jan. 2, 2003

(30) Foreign Application Priority Data

Mar. 9, 2000 (PL) ..... 338911

(51) Int. Cl.[7] ..... A61H 3/00
(52) U.S. Cl. ..... 135/67; 135/71; 482/67
(58) Field of Search ..... 135/65, 67, 69, 135/71, 73, 76; 623/31, 58; 601/5, 23, 34–35; 602/23; 482/67–69, 51, 124; 280/87.021

(56) References Cited

U.S. PATENT DOCUMENTS

| | | | | | |
|---|---|---|---|---|---|
| 503,105 | A | * | 8/1893 | Tingley | 482/67 |
| 2,010,482 | A | * | 8/1935 | Cobb | 623/31 |
| 2,210,269 | A | * | 8/1940 | Taylor | 601/33 |
| 2,833,332 | A | * | 5/1958 | Nabors | 482/67 |
| 3,195,550 | A | * | 7/1965 | Ingalls et al. | 135/67 |
| 3,557,782 | A | * | 1/1971 | Wafer | 602/23 |
| 3,709,216 | A | * | 1/1973 | Hilyard et al. | 606/237 |
| 4,226,413 | A | * | 10/1980 | Daugherty | 482/67 |
| 5,340,139 | A | * | 8/1994 | Davis | 280/304.1 |
| 5,467,793 | A | * | 11/1995 | Hart | 135/67 |
| 5,476,432 | A | * | 12/1995 | Dickens | 482/67 |
| 6,607,202 | B1 | * | 8/2003 | Palmer | 135/67 |
| 6,666,796 | B1 | * | 12/2003 | MacCready, Jr. | 482/51 |

FOREIGN PATENT DOCUMENTS

| | | | |
|---|---|---|---|
| GB | 1188647 | * | 4/1970 |
| PL | 176092 | | 9/1996 |
| PL | P-319821 | | 11/1998 |
| PL | P-337403 | | 7/2001 |

* cited by examiner

*Primary Examiner*—Winnie Yip
(74) *Attorney, Agent, or Firm*—Stites & Harbison PLLC; Marvin Petry

(57) ABSTRACT

A device is provided for enabling persons with paresis of lower limbs to walk. The device has vertical elements comprising an upper member and the lower member, each being adjustable in relation to each other. The vertical elements are interconnected by a jacket consisting of a three sided frame with two shorter sides and one longer side, joined together by corners at their respective ends, where the remaining longer side constitutes a closure. One of the connectors is pivotally attached to a connecting bar at the shorter side of the jacket frame, and the other is disconnectedly connected to a lock mounted at the end of another connecting bar of the opposite shorter side of the jacket frame. The shorter sides of the jacket frame, having mounted to them, from above, two adjustable armpit supports. The device has clamping rings for a user's thighs which are mounted to their respective connectors, which in turn are mounted adjustably and pivotally to the vertical elements.

4 Claims, 3 Drawing Sheets

DEVICE FOR ENABLING PERSONS WITH PARESIS OF LOWER LIMPS TO WALK

FIELD OF THE INVENTION

The present invention relates to ambulatory devices for handicapped persons with paresis of lower limbs for enabling them to walk.

BACKGROUND OF THE INVENTION

There are known devices which enable handicapped persons to walk. One of those devices is described in Polish Patent No 176092, in which the device consists of two parallel, flat, quadric mechanisms, situated symmetrically in relation to the vertical axis of the user, and where the axis of rotation of the vertical support bar linkage of each flat quadric mechanism corresponds with the hip joints of the user. The device also includes two special quadric mechanisms where both pairs of quadric mechanisms are interconnected by an intermediate member common to both pairs. The four linkages of the spatial quadric mechanism have their axis of rotation traversing the center of the respective hip joint of the user.

There is also known another device for aiding walking, described in Polish Pending Patent No. P-319821 consisting of an active, elliptical jacket, fixed to a mechanism to change the direction of walk. The device is open in its rear part and equipped with a locking device, and has two vertical members for forward motion. The device is equipped with two fixed cylindrical clamping rings for a user's thighs, which are open in their rear. The lower portions of the vertical members are equipped with platforms for the user's feet, to which there are rigidly fixed shoe skids, touching the floor to be walked on.

There is yet another known device for enabling persons with paresis of legs to walk, described in Polish Pending Patent No P-337403, consisting of two vertical elements, at either side of a jacket, and being twice bent inwards at their lower portions with two horizontal sections, and being attached by a pivot joint to triangle connections at upper portions. The triangle connections are pivotally fixed with their sides to respective sides of the jacket frame, while the horizontal sections are equipped with skids. Semi-circularly, bent outwards supports, are fixed to the skids where the diameter of the semi-circular supports are 1.5 to 2.5 times greater than length of horizontal sections of the bent parts of the vertical elements. The jacket frame in its forward part is pivotally fixed a triangle lever. The lever has bars with mounted flexible connectors. The bars are fixed at their other end to pivot elements consisting of a support for a person's back, where to the lower ends of the vertical elements within their pivot mounting with the skids, there are mounted Bowden cables, one at either side. Additionally, telescopic connectors interconnect the skids, in the vicinity of the semicircular supports.

The inconvenience of the prior devices consists of a lack of the possibility of adjusting the height of device's vertical elements to a users height, as well as lack of possibility of adjusting the size of the jacket to the user's corpulence.

U.S. Pat. No. 5,340,139 to Davis discloses a device enabling a handicapped person to move, which consists of the combination of a frame including a pair of lateral supports in spaced, parallel arrangement and a pair of large drive wheels which are rotatably secured at the rear ends of the lateral supports and a pair of castor wheels secured at the front ends of the lateral supports. A user support structure or a prone board comprising a pair of elongated rails, spanned at one end of by a chest pad, is pivotally secured to the lateral supports for pivoting between at least an upright or vertical position and a prone or horizontal position. With this device a handicapped person has the possibility of adjusting the user's structure to a patient's height and corpulence. When moving, the patient stands within the device and moves by means of the device's large wheels.

U.S. Pat. No. 6,666,796 to MacCready discloses an apparatus to assist human walking. The apparatus incorporates, in combination, first and second longitudinally extending strut members that are relatively movable, longitudinally, and adapted to transmit body associated loading. The first strut member or members are operatively connected to a rack and/or to the users body. The second strut member or members are slaved, i.e., operatively connected to the user's foot or feet, ankles or shoes to move therewith. The device provides the possibility of a user to adapt its structure to the height and corpulence of the user, but is not able to be employed by a patient with total immobility of legs, as the device requires the upwards and downwards movements of patient's feet in order to walk, i.e., the device requires the ability of a patient's treading.

SUMMARY OF THE PRESENT INVENTION

One object of the invention is to provide a device for enabling persons with paresis of lower limbs to walk, which, can be adapted to a patients height and corpulence, and which provides for the walking of persons with totally immovable legs, by means of torso and hand maneuvers only, thus facilitating a patient's training and rehabilitation.

The device according to the present invention comprises two substantially vertical, when in use, elements, with handles for the user's hands. The elements are interconnected at their upper end by a jacket with an internal frame situated at the side of the vertical elements upper ends. The vertical elements have fixed to their lower ends, skids with a foot platform. Each skid is fixed to one of the vertical elements by means of a flexible connection. A stabilizing rod connects the skids together and is adjustable in length. Clamping rings for user's thighs are attached to a lower portion of the vertical elements. The vertical elements each consist of two vertical members, fixed adjustably in height with respect to one another. The jacket consists of a three sided frame with two shorter sides formed from two shorter parts of adjustable length, spaced apart and in parallel arrangement for armpit supports to be mounted upon them, and a first longer side formed from a longer part of adjustable length, in perpendicular arrangement to the two shorter parts, joined together by corners at their respective ends. The frame is equipped with a second longer part of adjustable length, situated opposite to the first longer part and fixed at its ends to the shorter frame parts by means of two connectors, to one connector being fixed pivotally, to the second connector by means of engaging a lock situated at an end of the other shorter part of the frame. The flexible connection between the lower ends of the vertical elements and skids with foot platforms, consists of bushes fixed to upper surfaces of the skids near the middle of the skids' respective external edges, where the lower ends of the lower members of the vertical elements are introduced into the bushes and are spaced apart from the bushes internal wall by densely packed flexible material.

The clamping rings for a user's thighs are fixed to their respective connectors which, in turn, are mounted adjustably in height and pivotally to the vertical elements. The frame corners comprise two first bushes into which are inserted and adjustably fixed, a connecting bar which comprises the longer part of the frame and of two second bushes perpendicular to the first ones. A first connecting bar includes a first end inserted and adjustably fixed into one of the two bushes, and a second end of the connecting bar is pivotal, A second connecting bar includes a first end inserted and adjustably fixed in the second bush, and a second end of the second connecting bar is fixed by a lock at its end.

The lengths of each side of the frame can be adjusted in order to support a patient's torso thereby adapting the frame to the user's corpulence. The flexibility of connection of the vertical elements and skids with foot platforms provides for the user being able to move about, in a standing position, by balancing his or her body from one side to another and with the use of handles, is able to perform stepping like maneuvers of the device's vertical elements, thus training his or her lower limbs and avoiding their atrophy. The device is very simple and relatively inexpensive, and requires no initial patient's training before use.

BRIEF DESCRIPTION OF THE DRAWINGS

The object, features and attendant advantages of the present invention will be appreciated and better understood from the following detailed description of the preferred embodiment when considered with the accompanying drawings in which like reference numerals designate like or corresponding parts and wherein.

DETAILED DESCRIPTION OF THE PREFERRED EMBODIMENTS OF THE PRESENT INVENTION

Figures 1, 2:
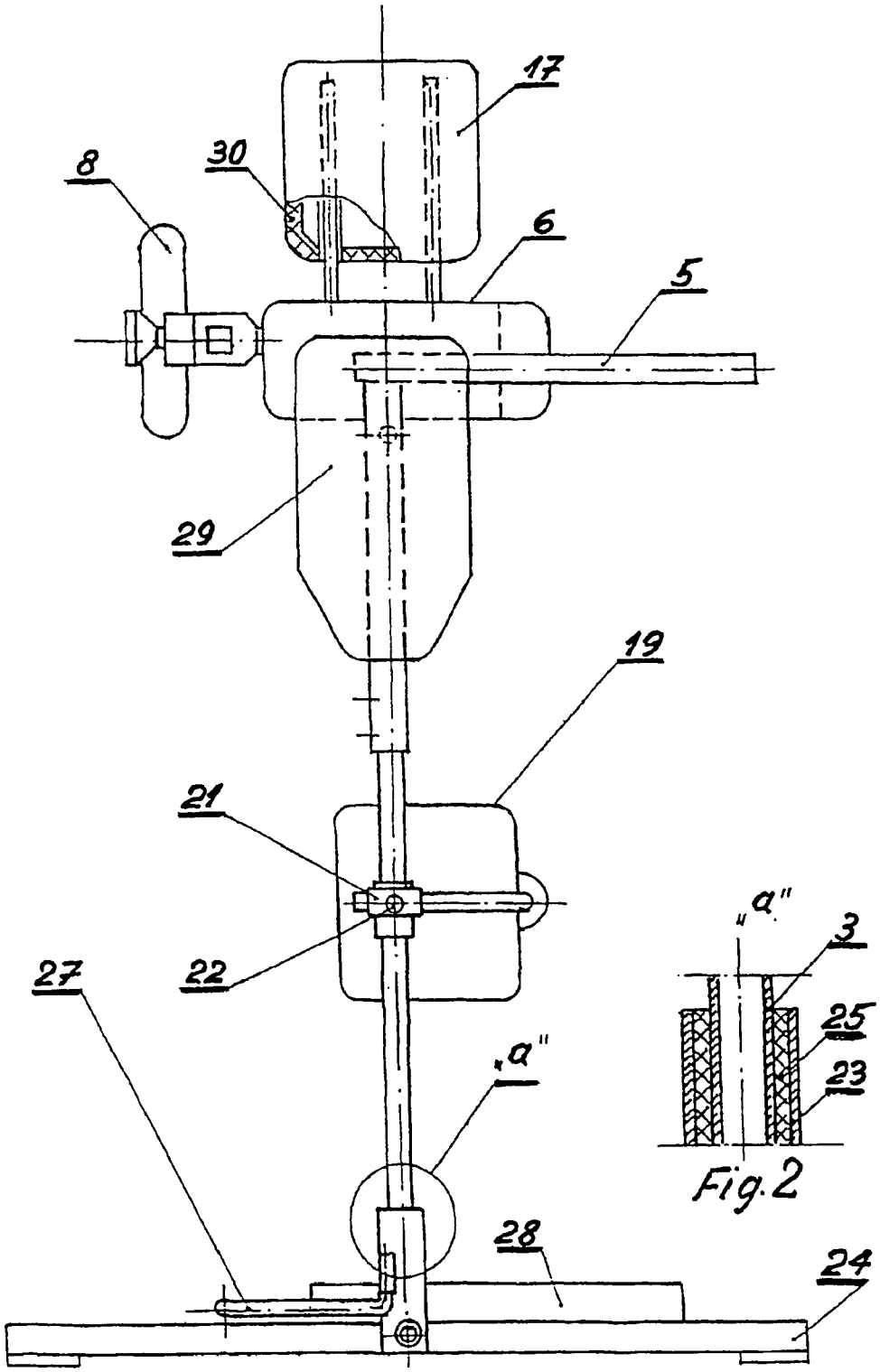
FIG. 1 shows lateral view of the device according to the invention.
FIG. 2 shows a detail of fixing the lower end of the vertical element.
Figure 3:
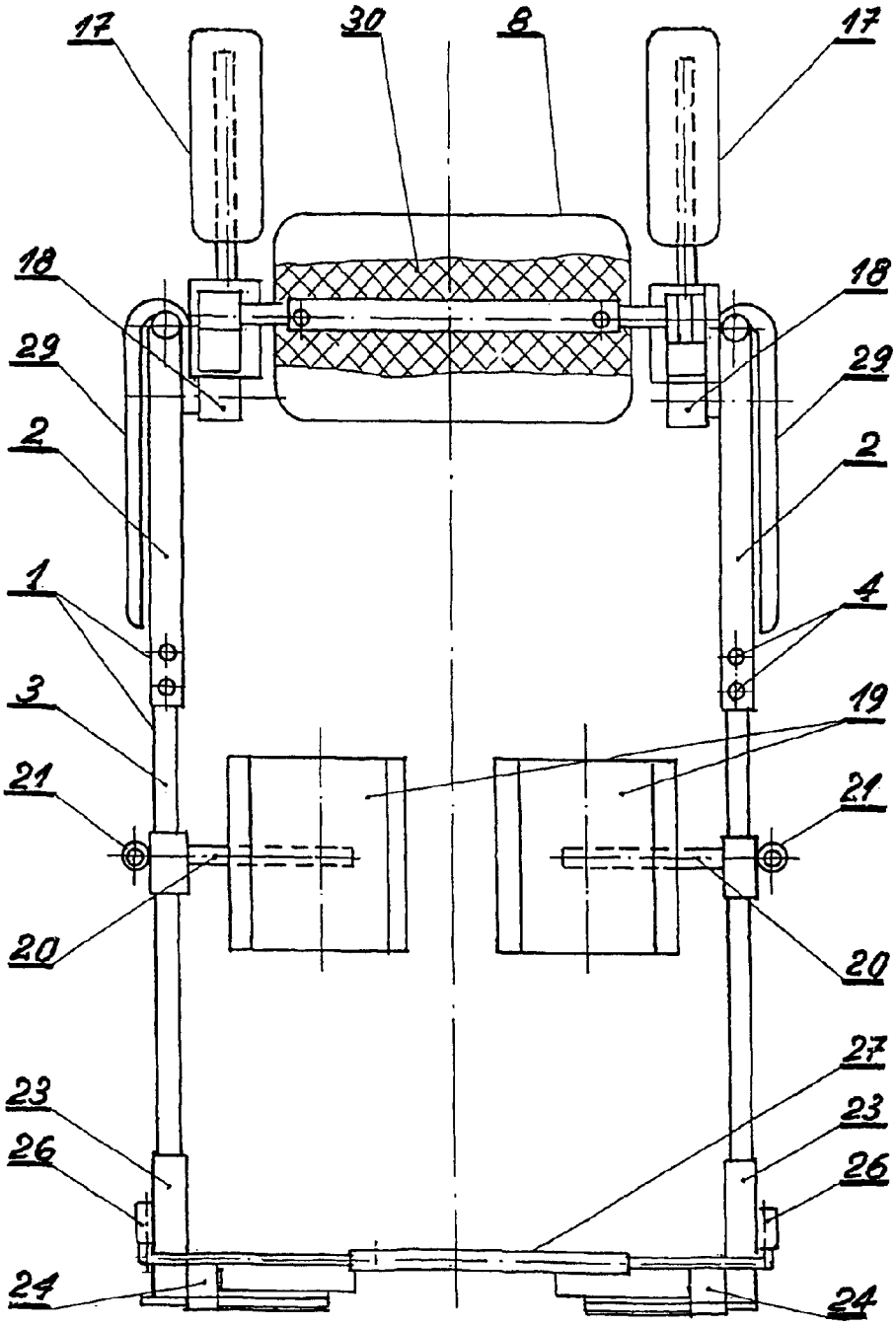
FIG. 3 shows the device viewed from the rear.
Figure 4:
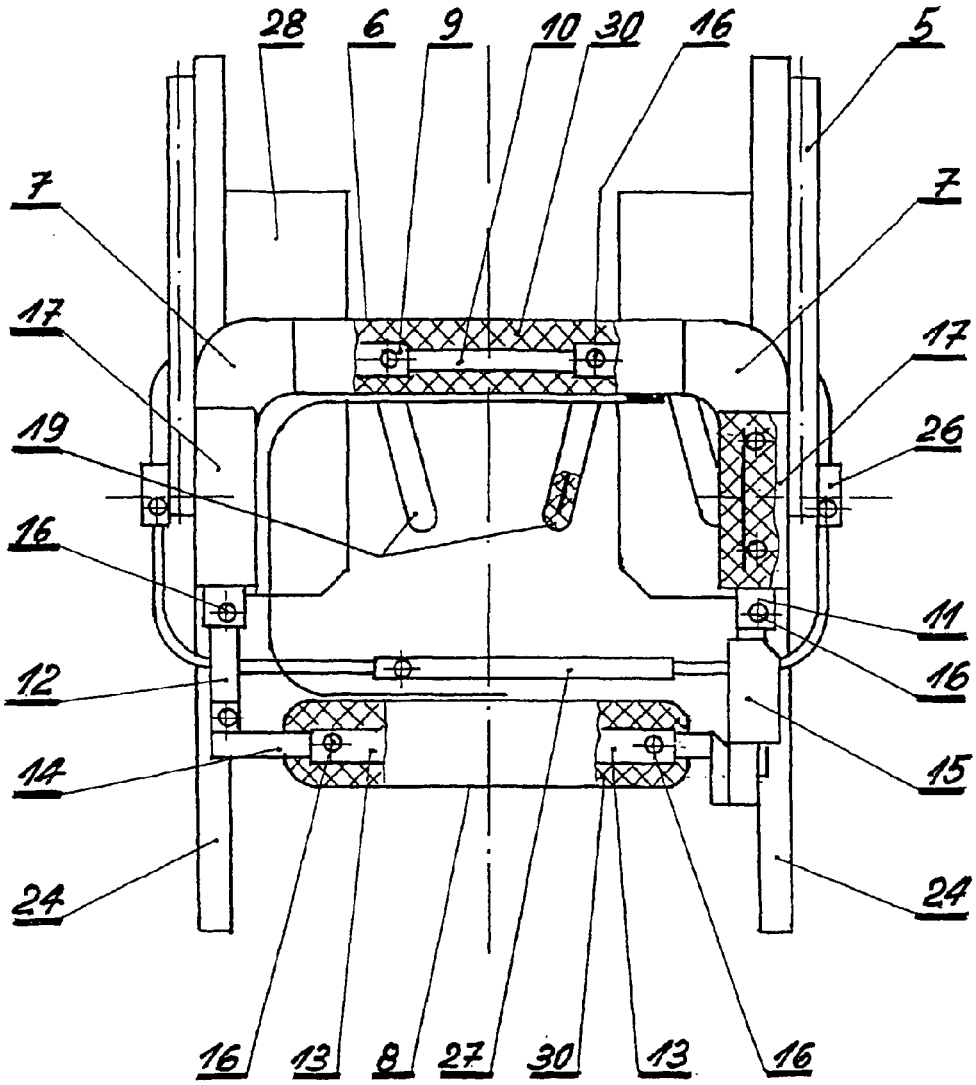
FIG. 4 shows the device viewed from above.

The device according to the present invention consists of two vertical elements 1 which in turn consist of two members, respectively upper member 2 and lower member 3. The lower members 3 are respectively, and adjustably inserted into upper members 2 equipped with screws 4 enabling to fix the required length of the vertical elements 1. The upper ends of the members 2 are equipped with handles 5 for the hands of the user. The upper members 2 at their top ends, are interconnected by a jacket 6, which is fixed to the members 2 by connectors 18. The jacket 6 consists of a three sided frame having corners 7 and a closure 8. The corners 7 are equipped with connecting bushes 9 situated at the longer side of the jacket frame, where they are adjustably, connected with a connecting bar 10 situated within the longer side of the jacket 6. The corners 7, at the shorter sides of the jacket 6 also have connecting bushes 11, into which are inserted adjustable connecting bars 12. The closure 8 of the jacket 6 consists of an elongated connecting bush 13 into which, at either end, are inserted connecting bars 14, where one connecting bar 14 is pivotally mounted to one of the connecting bars 12 and the other connecting bar 14 is mounted, by means of the lock 15 to the other connecting bar 12. The connecting bushes 9, connecting bushes 11 and elongated bush 13 are equipped with screws 16, which enable to block the relative position of respective connecting bushes and connecting bars. To the shorter sides of the jacket 6, are mounted, from above, in adjustable, displaceable manner (not shown) armpit supports 17. On the lower members 3 of the vertical elements 1 are mounted displaceable connectors 21, each consisting of two bushes pivotally cross interconnected; into one of the bushes is inserted the lower member 3; into the other bush is inserted one end of displaceable rods 20 bent at right angle, and fixed in their position by screws 22. To the other end of the rods 20 are mounted clamping rings 19 for user's thighs. The bottom ends of the lower members 3 of the vertical elements 1 are flexibly fixed into mounting bushes 23 fixed to the upper surfaces of the skids 24; near the middle of the skids' respective external edges, and the flexible connection of the members 3 and mounting bushes 23 is a coupling of an elastic and flexible material 25. Additionally, to the external surface of the mounting bushes 23 are fixed the respective ends 26 of a stabilizing rod 27 with adjustable length, and to the internal surfaces of the skids 24 are attached platforms 28 for the user's feet. The handles 5 for user's hands have attached side shields 29. All external surfaces of the jacket 6, armpit supports 17, and shields 29 are padded with a covering 30 of soft material.

Upon unscrewing the screws 4 it becomes possible to shift the members 2 to thus adjust the device to the user's height; then by changing the height of the armpit supports 17 to adjust them to the user's comfort, and by unscrewing screws 16, it become possible to adjust the jacket 6 to the corpulence of the user.

The action of walking with the device according to present invention is carried out in a manner as follow: by changing the location of the user's center of gravity, caused by swing movements of the upper part of the user's body, lifting of one and then another skid 24 is completed, which, in connection with small movements of user's hands holding handles 5 results in forward movement of the device. Stabilizing rod 27 with adjustable length, keeps the skids 24 always on the same surface.

What is claimed is:

1. A device for enabling persons with paresis of lower limbs to walk, said device comprising:

two substantially vertical elements, each having an upper member with an upper end and a lower member with a lower end, said members fixed adjustably in height relative to one another;

two handles for a user's hands, which handles are connected to said vertical elements at said upper ends, respectively;

a jacket with an internal frame and armpit supports situated at a side of said vertical elements, said frame interconnecting said vertical elements at said upper ends, said jacket comprising a three sided frame with two shorter sides formed from two shorter parts of adjustable length, spaced apart and in parallel arrangement and a longer side formed from a first longer part of adjustable length, in perpendicular arrangement to said two shorter parts, joined together by corners at their respective ends, said frame having a second longer part of adjustable length, situated opposite to said first longer part and fixed at its ends to said shorter parts by means of two connectors, one of said connectors being fixed pivotally on one of the shorter parts, and a second said connector fixed by being engaged in a lock situated at an end of the other shorter part;

skids with a foot platform, said skids being fixed to said lower ends of said vertical elements by means of an flexible connection and being connected to one another by a stabilizing rod of adjustable length; and clamping rings for a user's thighs which are fixed to said vertical elements in said lower ends.

2. The device of claim 1, wherein said flexible connection between said lower ends of said vertical elements and said skids comprise bushes fixed to upper surfaces of said skids near a middle of respective external edges of said skids, where said lower ends of said lower members are inserted into said bushes and spaced apart from internal walls of the bushes by densely packed flexible material.

3. The device of claim 1, wherein said clamping rings for a user's thighs which are fixed to respective connectors which, in turn, are mounted adjustably in height and pivotally to said vertical elements.

4. The device of claim 1, wherein said frame corners comprise two first bushes, each having an inserted, adjustably fixed first connecting bar which comprises said longer part, and two second bushes perpendicular to said first bushes, one of said second bushes having an adjustably fixed second connecting bar, which comprises one of said shorter sides of said frame, said second connecting bar pivotal at an end opposite said of said second bush, a second one of said second bushes having a third connecting bar which comprises the other said shorter side of said frame, said third connecting bar inserted in said second one of said second bushes and adjustably fixed, said third connecting bar having an end opposite said second one of said second bushes fixed via a lock.

* * * * *